US005201644A

United States Patent [19]

Henriksen

[11] Patent Number: 5,201,644

[45] Date of Patent: Apr. 13, 1993

[54] VALVE ARRANGEMENT FOR PUMP OR COMPRESSOR

[75] Inventor: Leif D. Henriksen, Porsgrunn, Norway

[73] Assignee: 3H Invent A/S, Skein, Norway

[21] Appl. No.: 898,180

[22] Filed: Jun. 12, 1992

Related U.S. Application Data

[63] Continuation of Ser. No. 488,079, Jun. 20, 1990, filed as PCT/NO88/00094 on Dec. 16, 1988, abandoned.

[30] Foreign Application Priority Data

Dec. 23, 1987 [NO] Norway ..... 875407

[51] Int. Cl.[5] ..... F04C 21/00

[52] U.S. Cl. ..... 417/48.4; 137/512.15; 92/121

[58] Field of Search ..... 417/482, 484, 571; 137/512.1, 512.5; 92/121, 122, 123, 124, 125

[56] References Cited

U.S. PATENT DOCUMENTS

| | | | |
|---|---|---|---|
| 2,524,682 | 10/1950 | Staude | 92/125 |
| 3,190,270 | 6/1965 | Peterson | 92/125 |
| 3,592,104 | 7/1971 | Harness | 92/122 |
| 3,696,713 | 10/1972 | Ragard | 92/121 |
| 3,827,833 | 8/1974 | Jinkawa | 417/482 |
| 3,879,942 | 4/1975 | Dorn et al. | 137/512.15 |
| 4,080,114 | 3/1978 | Moriarty | 417/484 |
| 4,385,872 | 5/1983 | Anderson | 417/571 |
| 4,565,507 | 1/1986 | Reimers | 137/512.15 |
| 4,642,037 | 2/1987 | Fritchman | 417/571 |
| 4,886,424 | 12/1989 | Ikeda et al. | 137/512.15 |
| 4,911,614 | 3/1990 | Kawai et al. | 47/571 |

*Primary Examiner*—Richard A. Bertsch
*Assistant Examiner*—Michael I. Kocharov
*Attorney, Agent, or Firm*—Francis C. Hand

[57] ABSTRACT

An arrangement for a compressor with oscillating piston wings has a series of mutually angularly displaced discharge slots arranged in a radially extending end wall between a working chamber of the machine and an oppositely disposed discharge chamber. The discharge slots are covered over by valve members of resilient nature. The valve members may be inserted in the end wall with an end groove in a recessed manner to engage a valve seat about each slot.

12 Claims, 3 Drawing Sheets

VALVE ARRANGEMENT FOR PUMP OR COMPRESSOR

This is a continuation of application Ser. No. 07/488,079 filed on Jun. 20, 1990, filed as PCT/NO88/00094 on Dec. 16, 1988, now abandoned.

Present invention relates to a value arrangement for a pump compressor or similar machine.

The present invention is designed particularly for use in machines of the type which employ a housing member having a plurality of partition walls defining working chambers therebetween and a rocking piston element pivotally mounted in the housing member with radially directed wings disposed in the chambers between the partition walls. Such machines are usually provided with various types of valve arrangements for exhausting compressed gasses or fluids from the working chambers, for example into a discharge chamber and are of especially high speed (rapidly oscillating) type, for example with a rotation range for the driving or the driven shaft of from 10,000 to 20,000 revolution/min. (that is to say a rotation range of from 111 to 333 revolutions/sec.) There is consequently a need for a valve arrangement which can be moved with an especially rapid movement between an open and closed position.

First and foremost, the objective is a valve arrangement where the valve member has a minimal mass, but nevertheless can function in an accurate manner with great effect. With this, it is of particular significance that the valve can provide minimal dead space between the valve member or the valve seat and the working chamber in the closed position of the valve.

The valve arrangement according to the invention is characterised in that the valve member is inserted in the end wall in a groove which has a minimum opening directed towards the working chamber and a maximum opening directed towards the discharge chamber and a valve seat arranged between these openings, the inner surface of the valve member being flush with or substantially flush with the adjacent inner surface of the working chamber.

By inserting the valve members in the end wall itself between the discharge chamber and the working chambers there is the possibility of placing the valve seats fairly tightly up to the working chamber, the valve seats being arranged between said maximum and minimum openings. In practice, the dead space between the valve seat and the working chamber can then be reduced to an insignificant minimum.

Further by allowing the inner surface of the valve member to be flush with the adjacent inner surface of the working chamber, one can allow the valve member to fill in completely or substantially completely the passage between the minimum and the maximum opening in the closed position of the valve member. By this, the possibility of the occurrence of dead space between the working chamber and the valve member or the valve seat can be substantially reduced.

By inserting the valve member in the end wall there is also the possibility, by way of simple means, of allowing movements of the valve member to be limited within the groove in the end wall with corresponding easy control of the movements of the valve member by way of simple means.

According to a special embodiment, the valve arrangement is characterised in that the valve seat is arranged between opposite openings (inlet opening and outlet opening) of a discharge slot, and in that the valve member and associated discharge slot have equivalent conical shapes between the valve seat and the inlet opening of the discharge slot.

By this, there is the possibility of being able to move the valve member in a simple and effective manner between open and closed positions mainly controlled by equivalent conical surfaces of valve member and discharge slot. At the same time, the valve member can fill in the discharge slot almost completely in the closed position of the valve. Furthermore, the valve members can be made with little weight and with relatively low volume.

It is preferred that the valve members are controlled by a common elastically yielding, that is to say spring-loaded valve means. By this, one can secure the valve members in position with a common valve means which can be fastened in a simple and ready manner and which can thereby secure the valve members of little weight and low volume effectively in position in associated discharge slots.

A valve arrangement is especially favourable in a construction which is characterised in that the discharge slots are controlled by their respective valve members which are each permanently connected to a common valve means, that the valve members are separately springable relative to the valve means, and that the valve means is inserted in the end wall together with the valve members in a common groove.

It is preferred that the valve means comprises an annular portion with finger-shaped valve members arranged in a common plane with the annular portion and extending radially from one side edge of the annular portion.

By this, there is the possibility of being able to control the valve members in an effective manner relative to each other so that minimal extra control means are required to guide the valve members accurately into position relative to the valve seat in the closed position of the valve and in a position displaced away from the valve seat in the opened position of the valve.

In order to achieve a most favourably possible control of the valve means and associated valve members, the valve arrangement is characterised in that the annular portion is arranged radially innermost and the finger member radially outermost, the annular portion being adapted to be fixed immovably or substantially immovably in an axial direction, while the finger members are separately pivotable across a radial plane through the annular portion.

By making the valve means with associated valve members of especially thin-walled construction, there can be obtained particularly little weight for the valve means and associated valve members, so that the valve members can be moved in an especially rapid and specially controlled manner relative to the valve means.

Furthermore, it is preferred that the valve members in the opened position of the valve can be supported against an extra support means which can have a shape corresponding to the valve means with associated valve members, but which has a substantially greater rigidity and strength than the unit of valve means and valve members. By means of the support means, the valve means and valve member can also be secured effectively in position relative to the groove in the end wall.

Further features according to the invention will be evident from the following description having regard to the accompanying drawings, in which.

Figure 1:
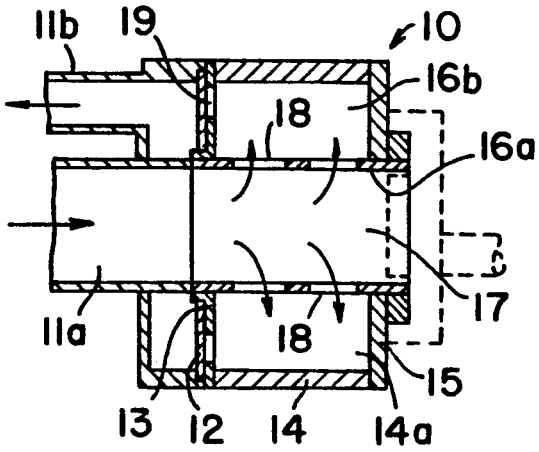
FIG. 1 shows a vertical section of a compressor according to the invention according to a first embodiment.
Figure 2:
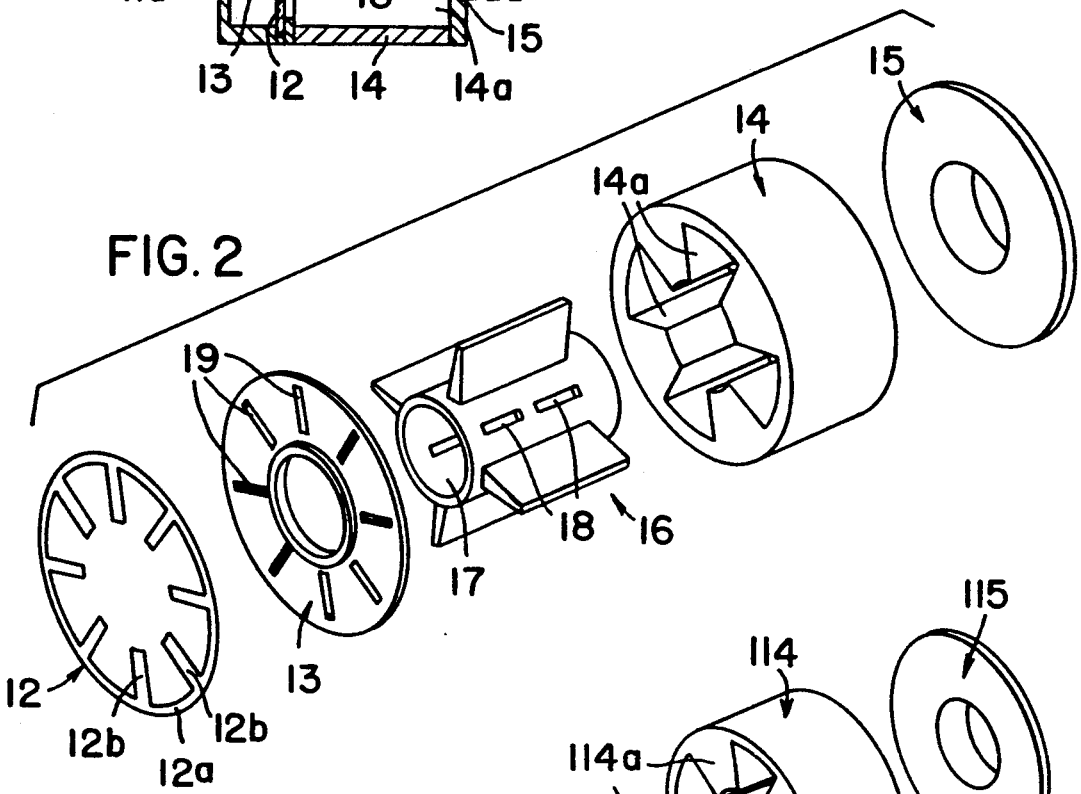
FIG. 2 shows a perspective view of the most important parts of the compressor according to FIG. 1

According to a first embodiment which is shown in FIGS. 1 and 2, the compressor 10 comprises a stator consisting of a manifold housing 11, a valve means 12, a first end wall 13, a compressor housing member 14 having partition walls 14*a* (see FIG. 2) and a second end walls 15 and an oscillator member consisting of a rocking piston element 16 having a cylindrical, sleeve-shaped hub portion 16*a* and several piston wings 16*b* directed radially outwards from this. For example four piston wings 16*b* can be employed and correspondingly four pairs of working chambers, as is illustrated, or where this is necessarily desired fewer or larger numbers of piston wing portions with a corresponding number of pairs of working chambers.

In one embodiment, there can also be employed for example three piston wing portions to form corresponding three pairs of working chambers, for example two pair of low pressure chambers and a pair of high pressure chambers which are based on the supply of pressure medium from the said two pairs of low pressure chambers.

As shown in FIG. 1, the manifold housing 11 is provided with a radially innermost medium intake 11*a* which communicates directly with an axially extending duct 17 internally in the hub portion 16*a*, which is provided with four pairs (only two pairs are shown in FIG. 2) of axially extending, first type port openings, in the form of elongate and narrow inlet slots 18, which pass radially through the body of the hub portion and which are controlled by the movement of the hub portion 16*a* relative to partition walls of 14*a* of the compressor housing. If desired the port openings can be designed with another shape than illustrated, for example with circular port openings.

The end wall 13 is provided with four pairs of radially extending ports openings of another type, in the form of elongate and narrow discharge slots 19, which pass axially through the body of the end wall 13. The valve means 12 comprises an annular support portion 12*a* from which four pairs of valve member-forming flaps 12*b* valve members project radially inwards, which are adapted to stationarily overlap the port openings or the discharge slots 19, the discharge slots 19 being adapted to be closed by the flaps 12*b* by means of the pressure of the medium on the downstream side of the medium outlet or by means of the inherent spring pressure in the flaps 12*b*. The discharge slots 19 are adapted to be opened by the working pressure, which builds up axially within the end wall 13. In practice the valve means 12 is made of an especially thin-walled, somewhat resilient material, the valve means being fixed stationarily between the radially outer peripheral portion of the end wall 13 and the radially outer peripheral portion of the manifold housing 11. Provision is made for a certain play in order to permit movement of the resilient flaps 12*b* away from the port openings 19.

In FIGS. 3 to 9 there is shown a second embodiment of the compressor which is illustrated in FIGS. 1 and 2.

Figure 3:
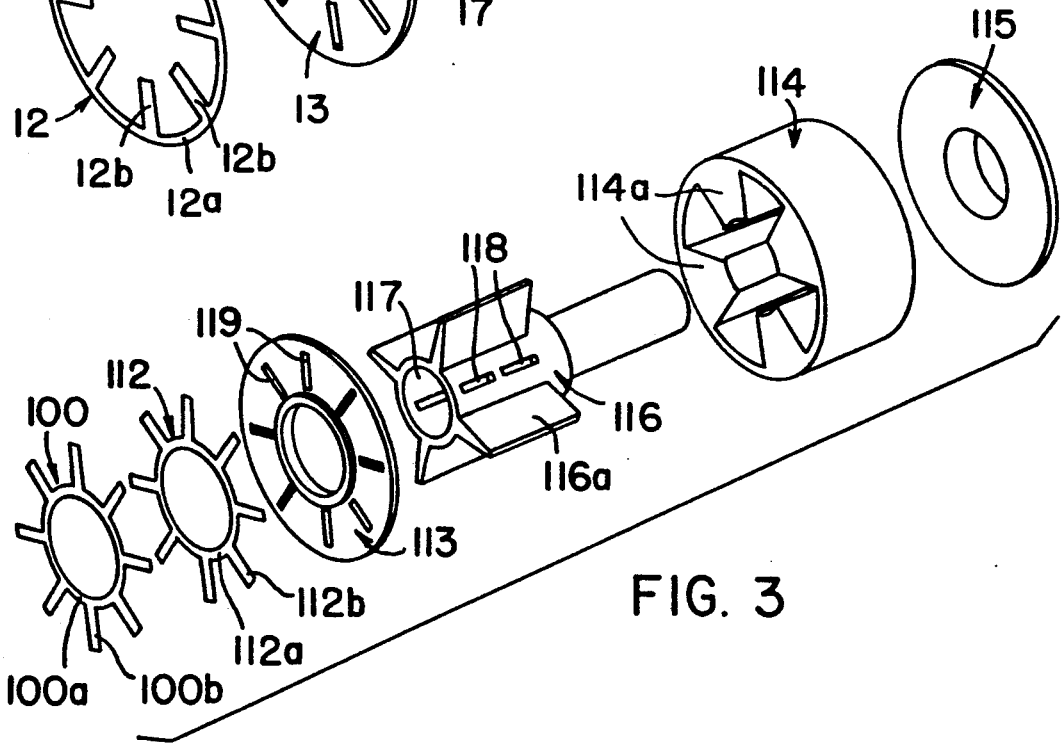
FIG. 3 shows a perspective view corresponding to FIG. 2 a compressor according to the invention according to a second embodiment.

In FIG. 3 there is shown a rigid and relatively thick-walled support means 100 which is adapted to form a support and stop for a relatively thin-walled valve means 112.

Figure 4:
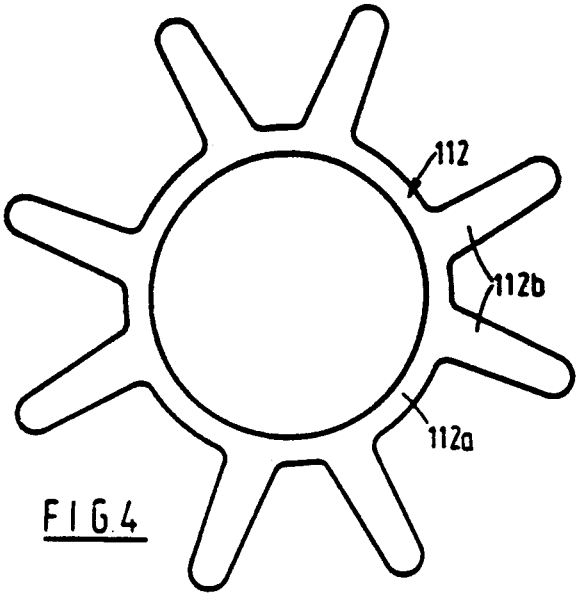
FIG. 4 shows in plan view a valve means according to FIG. 3.

The valve means 112 as shown in FIGS. 3 and 4 comprises an annular, radially inner support portion 112*a*. From this four pairs of valve-forming flaps 112*b* project radially outwards, which are adapted to stationarily overlap corresponding four pairs of discharge slots 119 in an end wall 113.

Figure 7:
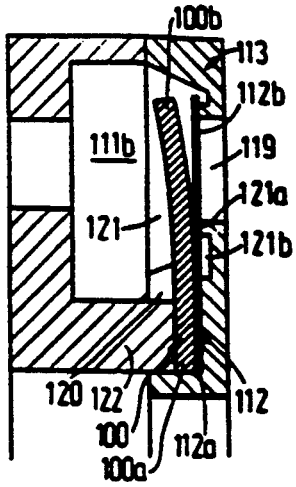
FIGS. 7 and 8 show in part a vertical section of the valve means according to FIG. 4 together with a support means fastened in position in the end wall as shown in FIG. 5, with the valve means illustrated in closed and open positions.
Figure 8:
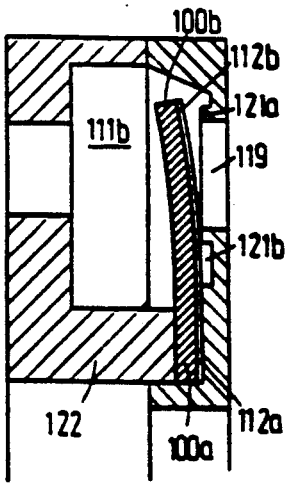
Figure 5:
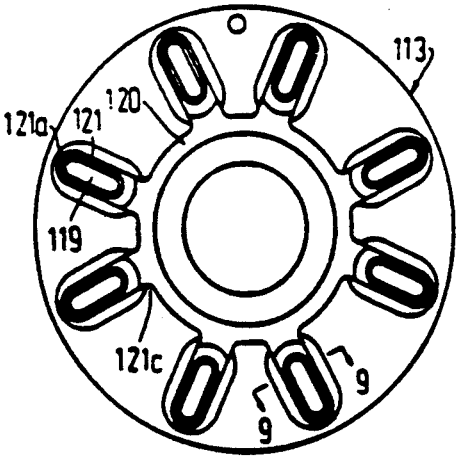
FIGS. 5 and 6 show an end wall according to said second embodiment seen from two opposite sides.
Figure 6:
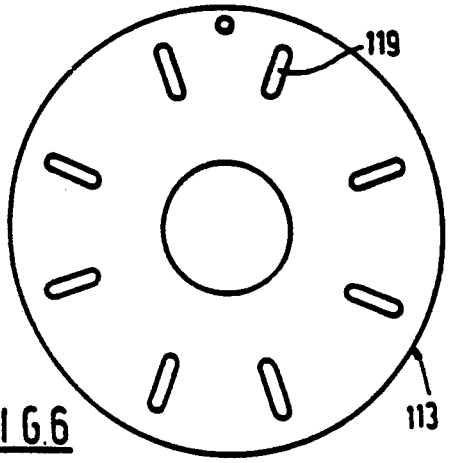

The support means 100 has a shape corresponding to the valve means 112 and is provided with an annular, radially inner support portion 100*a* and four pairs of flaps 100*b* which project radially outwards from the support portion 100*a*. As illustrated in FIGS. 7 and 8 flaps 100*b* of the support means are shown deflected obliquely outwards from the main plane of the support portion 100*a*, so that flaps 100*b* of the support means can support flaps 112*b* of the valve means in the second opened position of the valve means as shown in FIG. 8.

In corresponding manner as described above, the discharge slots 119 are adapted to be closed by the flaps 112*b* by means of the pressure of the medium on the downstream side of the medium outlet or by means of the inherent spring pressure in the flaps 112*b*. By arranging the support portion 112*a* according to the second embodiment radially innermost, instead of radially outermost, as shown in FIG. 2, there is obtained firstly a simpler and more effective fixing of the valve means independently of the manifold housing. Secondly, one can ensure that the support portion 112*a* according to FIGS. 3 and 4 can be designed with a far smaller surface area and thereby with a corresponding smaller mass.

By allowing the flaps 112*b* of the valve means 112 to be supported against flaps 100*b* of the support means 100 in the open position, there can be employed an especially small thickness for the valve means 112 and thereby this can be made in a simple and uncomplicated manner.

The discharge slots 119 in the end wall 113 are localised to a layer axially innermost in the end wall 113, just at the transition to the working chambers of the compressor. More specifically the discharge slots 119 are localised between the surface of the main side which faces towards the working chambers and a plane axially substantially inside the surface of the main side of the end wall 113 which faces towards the discharge chamber.

Figure 9:
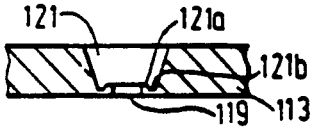
FIG. 9 shows a section taken along the line 9—9 in FIG. 5.

On the side which faces towards the discharge chamber, there is arranged a radially inner annular groove 120 with groove portions 121 projecting radially outwards from this. The annular groove 120 and the groove portions 121 have a form which corresponds to the form of the support portion 112*a* and the flaps 112*b* and the support portion 100*a* and the flaps 100*b*. Centrally in the groove portions 121 there is designed the inlet opening to the elongate discharge slots 119 and laterally on the inlet opening there is defined in the groove portion 121 a valve seat 121*a* which forms a support surface for the associated valve memberforming flap 112*b*. The valve seat 121*a* is as shown in FIG. 9 formed by an annular bulb in the bottom of the groove portion 121, the bulb being produced by means of an extra annular cavity in the bottom of the groove portion 121.

The annular groove 120 and the groove portions 121 have a thickness (reckoned axially in the end wall 113) which is greater than the combined thickness of the thickness of the support portion 112*a* and the flap 112*b* together with the support portion 100*a* so that the two sets of flaps are received in recessed manner. As shown in FIGS. 7 and 8 the support portion 112*a* and the support portion 100*a* are secured by a stop member 122 radially innermost in the annular groove 120. The flaps 112*b* are adapted to be pivoted independently of each other, as is indicated in FIGS. 7 and 8, but limited by the contour of the support member 100. In practice all the flaps 112*b* will be pivoted in step with each other between a closed position as shown in FIG. 7 and an opened position as shown in FIG. 8. From the groove portions 121 there extend obliquely outwards guide surfaces 121*b* for effectively leading compressed air via a passage between the valve seats 121*a* and the flap 112*b* in its opened position to the adjacent discharge chamber. At 121*c* there are shown shoulder portions which guide the flaps 112*b* into place during the pivotal movement of the flaps between the two positions which are shown in FIGS. 7 and 8, so that unintended rotation of the support portion 112*a* and the support portion 100*a* in the associated groove 120 in the end wall 113 is avoided.

Figure 10:
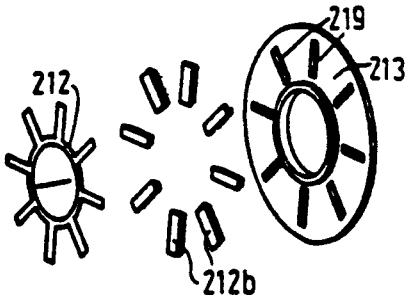
FIG. 10 shows in a perspective exploded view in a third embodiment of a valve arrangement according to the invention.
Figure 11:
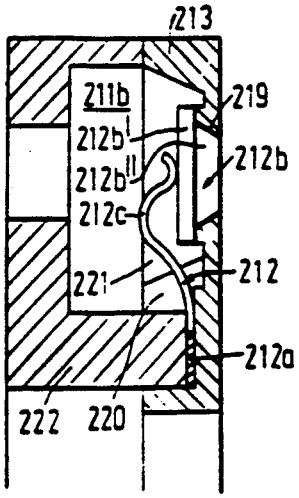
FIGS. 11 and 12 show in part as shown correspondingly in FIGS. 7 and 8 the valve arrangement according to FIG. 10 in closed and open positions.
Figure 12:
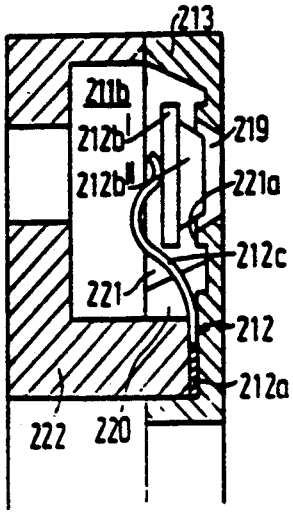

In FIGS. 10 to 12 there is shown a third embodiment where there is illustrated an end wall 213 with four pairs of discharge slots 219. In FIG. 10 the arrangement is shown schematically while the arrangement is illustrated in more detail in FIGS. 11 and 12. There are shown four parts of valve members 212*b* which are supported by a common separate support member 212. The valve members 212*b* and the support member 212 are fastened in an annular groove 220 and in groove portions 221 in a manner corresponding to that shown in the embodiment according to FIGS. 3 to 9. Each valve member 212*b* is shown in FIGS. 11 and 12 provided with a valve head portion 212*b'* which forms a support abutment against a valve seat 221*a* laterally outside the discharge slot 219 and is provided with a projection 212*b''* which has an equivalent form (conical shape) and essentially equivalent or somewhat smaller dimensions than the discharge slot. By this, the projection 212*b''* can be in the closed position of the valve fill in almost completely the dead space which is present between the working chamber and the valve seat. By designing the projection 212*b''* and the discharge slot 219 with substantially corresponding conical shapes the projection has the possibility of relatively free movement in the discharge slots during the opening and closing of the valve and then with a self-centering adjustment of the projection in the discharge slot.

According to FIGS. 11 and 12 there is shown a support element 212' in the form of an elastically resilient support means which is common to the separate valve members 212*b*. The support element 212' has an annular support portion 212*a'* which is fixed in the annular groove 220 by means of a stop member 222. While flaps 212*c'* of the support element are designed with an S-shape in a plane at right angles to the main plane of the support element 212' so as to bias the valve members 212*b* against the valve seats 221*a* and towards the slots 19.

Figure 13:
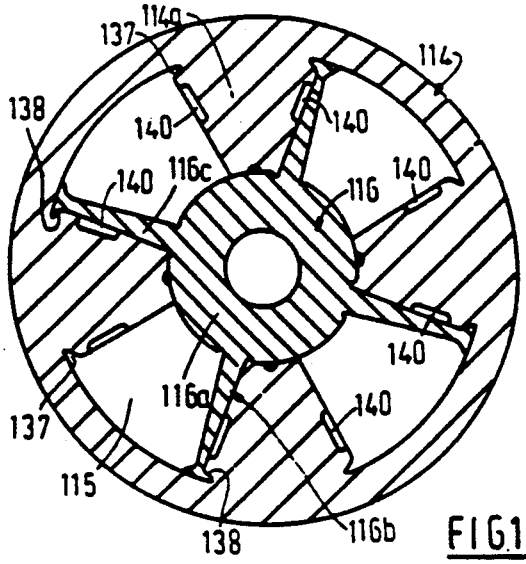
FIGS. 13 and 14 show sections through the machine housing with an oscillator member illustrated in two equivalent outer positions.
Figure 14:
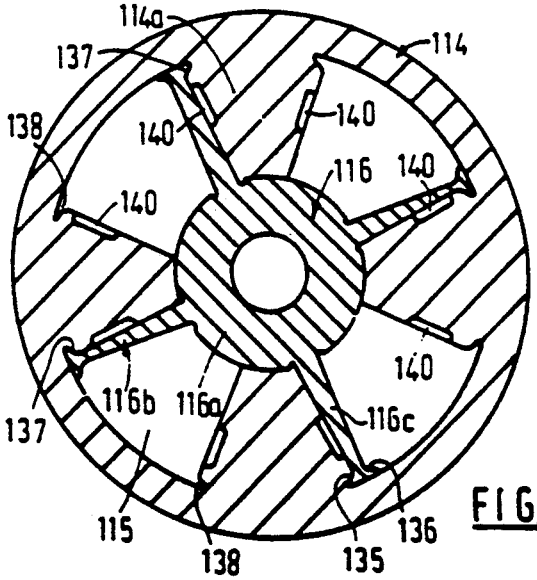
Figure 15:
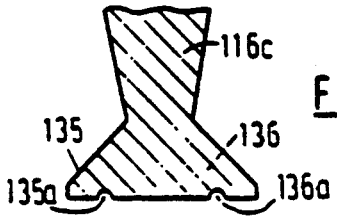
FIG. 15 shows in detail a section of the oscillator member according to FIG. 13.

In FIGS. 13 and 14 there is shown a cross-section of a compressor housing member 114 with associated partition walls 114*a* and an end wall 115 (opposite the discharge chamber) together with a rocking piston member 116 having a cylindrical, sleeve-shaped central portion 116*a* and four piston wings 116*b* directed radially outwards from this. The piston wings 116*b* are of especially thin-walled design in order to ensure the least possible mass in the oscillator member so as to be able thereby to ensure an especially rapid oscillatory movement. The piston wings 116*b* have for strength reasons a substantially T-shaped cross-section. Stem portion 116*c* of the T shape, which in itself is made of relatively thin-walled construction, is broadest at the inner end and narrowest at the outer end where the stem portion passes over into a cross web or flaps 135, 136. The flaps 135, 136 are for their part also broadest at the inner end and narrowest at the outer end. In the partition walls 114*a* there are formed on opposite side cavities 137, 138 with a cross-section corresponding to the flaps 135, 136, so that air which is present in these cavities is displaced by the flaps during movement of the piston wing portion to respective outer positions in associated working chambers. By this, there can be obtained an effective buffer effect between the oscillator member and associated partition walls 114*a* and a large end surface according to the conditions. In the end surface of the cross web there are formed a pair of longitudinal lubricating grooves 135*a*, 136*a*, such as shown in FIG. 15.

In the partition walls 114*a*, there is cut out an obliquely extending guide groove 140 which at end surfaces of the partition walls has a shape and size corresponding to slots 119 of the end wall 113 (see FIG. 5) and opens axially outwards flush with these. If desired, the stem portion of the piston wings can be provided with a corresponding projection (not shown further) which on pivoting the piston wing to the outer position can be pivoted inwardly into the cavity in order to displace the pressure medium which is cut off in the same.

I claim:

1. A compressor comprising a housing member including a plurality of partition walls defining working chambers therebetween;

a rocking piston element pivotally mounted in said housing member and having radially directed wings disposed in said chamber between said partition walls, said rocking piston element including a hollow hub portion defining a flow path for a pressure medium, said hub portion having said wings mounted radially thereon and having a plurality of inlet slots between said wings for passage of the pressure medium therethrough into said respective working chambers;

a radially extending end wall at one end of said housing member having a plurality of circumferentially spaced grooves in an end face remote from said working chambers and a plurality of slots, each slot being disposed within a respective groove to communicate with a respective working chamber;

a plurality of valve seats, each valve seat being disposed about a respective slot on a side remote from said working chambers; and a plurality of valve members, each valve member being disposed within a respective groove in sealing relation with a respective valve seat over a respective slot.

2. A compressor as set forth in claim 1 wherein each valve member is of conical shape to matingly seat within a respective slot with a face said valve member flush with a face of said end wall facing said working chambers.

3. A compressor as set forth in claim 1 which further comprises an annular support portion having said valve members extending radially therefrom.

4. A combination as set forth in claim 3 wherein each valve member is a resilient finger-shaped member.

5. A combination as set forth in claim 3 which further comprises a support means engaging said annular support portion and including radially directed and deflected flaps for supporting said valve members in an opened state relative to said slot.

6. A combination as set forth in claim 1 which further comprises a support means including radially directed and deflected flaps for supporting said valve members in an opened state relative to said slots.

7. In a compressor, the combination comprising a housing member including a circumferentially spaced partition walls defining working chambers therebetween;

a rocking piston element pivotally mounted in said housing member and having radially directed wings disposed in said chambers between said partition walls, said rocking piston element including a hollow hub portion defining a flow path for a pressure medium, said hub portion having said wings mounted radially thereon and having a plurality of inlet slots between said wings for passage of the pressure medium therethrough into said respective working chambers;

a radially extending end wall at one end of said housing member, said wall having a plurality radially disposed slots in communication with said working chambers; and valve means for closing said slots, said means including an annular support portion adjacent said end wall and a plurality of radially disposed resilient flaps extending from said support portion, each flap being disposed over a respective slot in sealing relation.

8. The combination as set forth in claim 7 which further comprises a support means for said valve means, said support means including an annular support portion and radially directed and deflected flaps for supporting said resilient flaps of said valve means in response to bending of a respective resilient flap away from a respective slot.

9. The combination as set forth in claim 8 wherein said end wall has a plurality of grooves in a face remote from said working chambers receiving said resilient flaps of said valve means and said flaps of said support means in recessed manner.

10. In a compressor, the combination comprising a housing member including a plurality of circumferentially spaced partition walls defining working chambers therebetween;

a rocking piston element pivotally mounted in said housing member and having radially directed wings disposed in said chambers between said partition walls, said rocking piston element including a hollow hub portion defining a flow path for a pressure medium, said hub portion having said wings mounted radially thereon and having a plurality of inlet slots between said wings for passage of the pressure medium therethrough into said respective working chambers;

a radially extending end wall at one end of said housing member, said wall having a plurality of radially disposed slots in communication with said working chambers;

valve means for closing said slots, said means including a plurality of valve members, each said valve member being disposed in sealing relation over a respective slot; and a support element having an annular support portion and a plurality of flaps biasing said valve members towards said slots.

11. The combination as set forth in claim 10 which further comprises a valve seat about each respective slot and receiving a respective valve member thereon.

12. The combination as set forth in claim 11 wherein each valve member has a conical projection projecting into a respective slot in mating relation.

* * * * *

UNITED STATES PATENT AND TRADEMARK OFFICE

CERTIFICATE OF CORRECTION

PATENT NO. : 5,201,644

DATED : April 13, 1993

INVENTOR(S) : Leif D. Henriksen

It is certified that error appears in the above-identified patent and that said Letters Patent is hereby corrected as shown below:

Column 1, line 7, change "value" to -valve-
Column 5, line 63, cancel "be"
Column 7, line 16, after "face" insert -of-
  Line 34, after "including a" insert -plurality of-
  Line 48, after "a plurality" insert -of- Signed and Sealed this Twenty-first Day of December, 1993

*Attest:*

Bruce Lehman

BRUCE LEHMAN

*Attesting Officer*

*Commissioner of Patents and Trademarks*